United States Patent [19]

Geisinger

[11] 4,387,922

[45] Jun. 14, 1983

[54] CARRYING HANDLE

[76] Inventor: Wolfgang G. Geisinger, 352 Rosemere Blvd., Rosemere, Quebec, Canada, J7A 2T5

[21] Appl. No.: 270,648

[22] Filed: Jun. 4, 1981

[30] Foreign Application Priority Data

Mar. 23, 1981 [CA] Canada ..... 373599

[51] Int. Cl.[3] ..... A47J 45/00; B65D 25/28; A47G 29/02

[52] U.S. Cl. ..... 294/31.2; 215/100 A; 220/94 R

[58] Field of Search ..... 220/94 R, 94 A, 96, 220/4 A, 314, 214; 215/100 A; 294/31.2, 149, 157; 206/509, 821; 16/114 R, 119; 277/212 C; 229/52 R, 52 A, DIG. 6, 43; 92/243

[56] References Cited

U.S. PATENT DOCUMENTS

| | | | |
|---|---|---|---|
| 2,047,120 | 7/1936 | Stout | 92/243 X |
| 3,000,527 | 9/1961 | Jennings et al. | 220/94 R |
| 3,441,172 | 4/1969 | Dike | 220/94 A |
| 3,480,177 | 11/1969 | Elliot | 229/43 |
| 3,563,557 | 2/1971 | Doutt | 92/243 X |
| 3,581,928 | 6/1971 | Amand | 220/94 A X |
| 3,612,595 | 10/1971 | Updegraff et al. | 294/31.2 |
| 3,620,410 | 11/1971 | Griese, Jr. | 220/94 R |
| 3,807,679 | 4/1974 | Burke et al. | 215/100 A X |

*Primary Examiner*—Allan N. Shoap
*Assistant Examiner*—Robert Petrik
*Attorney, Agent, or Firm*—C. A. Rowley

[57] ABSTRACT

A carrying handle is formed by a continuous band adapted to encircle the container and provided with a handle member integrally connected hereto. A projection extends outwardly from the band and a tab projects inwardly from the handle in a position to engage with the projection. The tab is spaced outwardly of the projection when the band is in relaxed condition and overlaps with the projection when said band is in stretch condition encircling the container.

7 Claims, 6 Drawing Figures

CARRYING HANDLE

FIELD OF THE INVENTION

The present invention relates to a band type handle adapted to be applied to a container. More particularly the present invention relates to a handle structure including a continuous band adapted to extend circumferencially of the container and provided with a handle member integrally connected thereto and having a means to hold the handle in retracted position.

BACKGROUND TO THE INVENTION

The concept of using container encircling bands to secure a handle member to a container is well known. For example, Canadian Pat. No. 779,796 issued Mar. 5, 1968 to Song discloses an arrangement that provides a bale handle for a container having an upper rim. The encircling band fits snugly around the body of the container and abutts with the bottom edge of the rim when the container is carried by the strap type handle extending from the band. This device has a pair of reverse folds, positioned one adjacent each end of the bale handle at its connection to the band, that tend to hold the bale handle substantially in the plane of the encircling band until the bale is first lifted from this position.

Another handle arrangement with an encircling band as shown in Canadian Pat. No. 969,899 issued June 24, 1975 to Klygis. This patent teaches the use of a strap handle and encircling band that is received snugly underneath the upper rim of a can. The complete handle structure is cut from a flat sheet. However when the handle of this patent is lifted the point of transfer of forces from the handle to the band is at the lower most edge of the band which tends to turn the band inside out and lift the handle from the container.

Applicant's earlier Canadian application number 334275 filed Aug. 22, 1979 discloses a handle structure overcoming most of the disadvantages of these prior devices. That application discloses a band having a substantially concave inner face adapted to engage the body of the can along two lines spaced axially of the container to provide areas of stress concentration. In this arrangement the handle member projects from the band and was integrally connected thereto at a pair of dyametrically opposed locations. A flat connecting section substantially in the plane of the circumferencially extending band and positioned adjacent the connection between the band and the handle provides a hinge structure permitting flexture of the handle into operative or carrying position. This device functions very well however when it is desired to ensure that the handle is positioned below the upper surface of the can there is no mechanism to guarantee this positioning.

BRIEF DESCRIPTION OF THE INVENTION

It is thus the object of the present invention to provide an improved handle structure provided with means to latch the handle in inoperative position.

Broadly the present invention comprises a handle structure having a continuous band adapted to extend circumferencially of a container, a handle member integrally connected with said band at a pair of spaced locations and extending part way around the circumference of said band, a projection extending outwardly from said band, a tab projecting inwardly from said handle at a position between said locations to cooperate with said projection, said tab being spaced outwardly from said projection when said band is in relaxed condition and overlapping said projection when said band is in a stretch condition encircling a container.

BRIEF DESCRIPTION OF THE DRAWINGS

Further features, object and advantages will be evident from the following detailed description of the preferred embodiments of the present invention taken in conjunction with the accompanying drawings in which.

DESCRIPTION OF THE PREFERRED EMBODIMENTS

Figure 1:
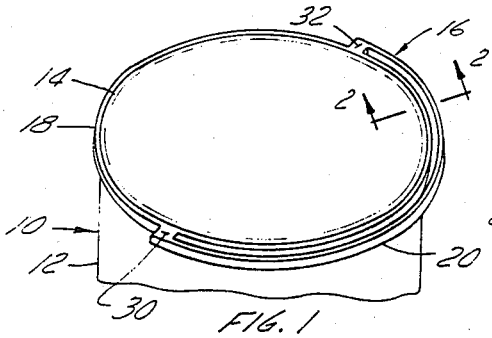
FIG. 1 is an isometric view of the present invention applied to a container.
Figure 2:
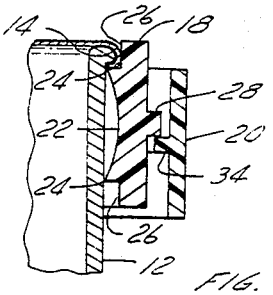
FIG. 2 is a section along the line 2—2 of FIG. 1.

As shown in FIGS. 1 and 2, can 10 has a body portion 12 with an upper rim or bead 14 forming part of the top closure of the can. The handle member 16 is composed of a body encircling band 18 and a handle 20. As shown in FIG. 2 the body encircling band 18 has an inner concave surface 22 terminating in a pair of spaced contact lines 24. Positioned outside of the concave section 22 are a pair of undercut areas 26 adapted to receive the bead 14. The band and handle 20 are preferably symmetrical about their longitudinal axis so that the handle member may be applied either side up when it is applied to the container.

The band 18 is provided with a circumferencially extending projection or bead 28 adapted to reinforce the band structure and to provide a latching mechanism to be described herein below. If only a latch is required the bead need only extend for a short distance circumferentialy in a position to engage with latching tab 34 in a manner to be described below.

The circumferencially extending projection or bead 28 extends an equal distance on opposite sides of the longitudinal centre line of the band 18 i.e. it is also symetrical with respect to the longitudinal centre line of the band.

Figure 3:
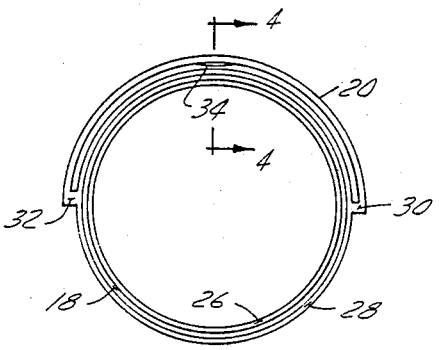
FIG. 3 is a planned view of the handle structure of the present invention.

The handle member 20 is molded integrally with the band 18 and is connected thereto at a pair of diametrically opposed points as indicated at 30 and 32 respectively. (See FIG. 3.) Suitable weakening of the band in the areas adjacent the connections 30 and 32 permit the band to flex from the position illustrated in FIGS. 1, 2 and 3 to a position wherein the handle member 20 extends substantially perpendicularly to the band 18.

As illustrated the handle member 20 extends between the connecting points 30 and 32 i.e. substantially half of the circumferencial distance around the band member 18 and is provided in the illustrated arrangements at about the mid point of its length with a latching tab 34 projecting inwardly toward the band 18.

Figure 4:
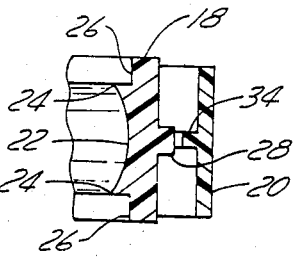
FIG. 4 is a section along the line 4—4 of FIG. 3.

When the handle structure is molded the handle member 20 is spaced from the band 18 so that the tab 34 does not overlap the projection 28 and is spaced outwardly therefrom as shown in FIG. 4.

To apply the handle to the container requires expanding of the band 18 to snap same over the rim 14 and onto the container body 12 and to apply pressure along the two pressure lines 24 to hold the band in tight relationship with the body of the container i.e. the band 18 remains in stretched condition encircling the body 12 of the can. The rim 14 is adapted to be received in the uppermost undercut 26 as shown in FIG. 2. This expansion of the band 18 moves the projection 28 outwardly beyond the tab 34 the band is holded in this position when the band 18 is snugly engaging the container i.e. when the band is applied to the container it remains in stretched or elongated condition expanding the diameter of the band 28 so that it overlaps with the projection 34 as shown in FIG. 2.

Figure 5:
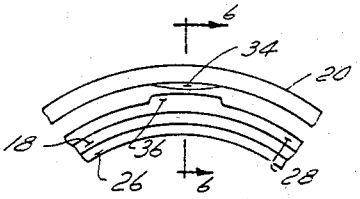
FIG. 5 is a plan view similar to FIG. 3 illustrating a modified version of the present invention and FIG. 6 is a section along the line 6—6 of FIG. 5 but showing the handle member applied to a container.

If it is desired to make the handle member 20 longer it is possible to provide a local extension of the bead 28 as indicated at 36 in FIG. 5 (or the tab 34 widened) which will thereby permit the making of a longer handle and still retain the latching mechanism.

Figure 6:
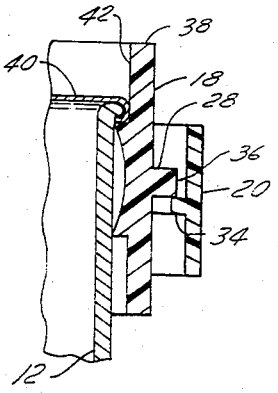

It is also possible as indicated in FIG. 6 to extend the height of the undercut 26 to be significantly longer than the depth of the chime or rim 14 so that the upper edge 38 of the band 18 projects well above the upper surface 40 of the can to provide a rim 42 extending circumferencially of the can. Obviously for extension of the band 18 to provide the rim 42 requires that the handle member 20 be longer in order to clear the rim when it is lifted to an operative position. (See FIGS. 5 and 6.)

The rim 42 permits stacking of the container so that the bottom of one container may nest in the rim 42 formed by the handle member applied to the bottom container. This rim also reduces splashing out of the container and may be particularly useful when paint is to be contained in the container 10 for wiping of the brush.

During assembly of the band onto the container i.e. when the band 18 is expanded it may be desirable to position the tab 34 out of alignment with the bead 28 so the tab does not interfere with expansion of the band 18. Preferably the tab 34 will be positioned so that it will be in latched position on the can for shipment.

Having described the invention modifications will be evident to those skilled in the art without departing from the spirit of the invention as defined in the apended claims.

I claim:

1. A handle structure comprising a continuous band adapted to be stretched to extend circumferentially of a container, a handle member integrally connected to said band at a pair of spaced locations and extending part way around the circumference of said band a projection in the form of a rib extending radially outwardly and circumferentially of said band, a tab projecting inwardly from said handle at a position between said locations located to cooperate with said projection, said projection being radially spaced inwardly of said tab when said band is in a relaxed condition prior to being applied to said container and, said tab being in a position to engage said projection when said band is in stretched condition encircling said container.

2. A handle structure as defined in claim 1 wherein said projection extends circumferencially of said band along substantially the full circumference thereof.

3. A handle structure as defined in claim 2 wherein said tab is located midway between said locations and wherein said locations are at diametrically opposed positions relative to said container and wherein said projection is centered on the longitudinal centre line of said band.

4. A handle structure as defined in claim 1 wherein the transverse cross section of said band includes a concave innerface defining two spaced lines of contact with said container, the lines of contact being symetrically positioned on opposite sides of the longitudinal centre line of said band and wherein said projection is centred on the longitudinal centre line of said band.

5. A handle structure as defined in claim 4 further comprising an undercut extending along said band on the inner face thereof outside of said concave section, said undercut being adapted to receive a rim on said container.

6. A handle structure as defined in claim 5 further comprising an extention extending latterly from said undercut of said band and adapted to form a rim projecting above said container when said band is in place on said container with said undercut being adapted to receive a rim on said container.

7. A handle structure as defined in claim 6 wherein said band is symetrical on opposite sides of its said longitudinal axis.

* * * * *